US005771804A

United States Patent [19]

Knauer et al.

[11] Patent Number: 5,771,804

[45] Date of Patent: Jun. 30, 1998

[54] DRIVE WITH RESISTER DEVICE FOR A PRINTING UNIT OF A ROTARY PRINTING MACHINE

[75] Inventors: Peter Knauer, Münster/Lech; Josef Singler, Augsburg, both of Germany

[73] Assignee: MAN Roland Druckmaschinen AG, Offenbach AM Main, Germany

[21] Appl. No.: 833,077

[22] Filed: Apr. 3, 1997

[30] Foreign Application Priority Data

Apr. 12, 1996 [DE] Germany ..... 196 14 397.7

[51] Int. Cl.[6] ..... B41F 5/00

[52] U.S. Cl. ..... 101/183; 101/181; 101/216; 101/248

[58] Field of Search ..... 101/181, 248, 101/216, 217, 183, 141, 153, 180, 212, 219

[56] References Cited

U.S. PATENT DOCUMENTS

| | | | |
|---|---|---|---|
| 2,260,402 | 10/1941 | Potdevin | 101/248 |
| 3,496,865 | 2/1970 | Fischer | 101/248 |
| 3,791,294 | 2/1974 | Skelding et al. | 101/248 |

FOREIGN PATENT DOCUMENTS

| | | | |
|---|---|---|---|
| 04 01 656 | 12/1990 | European Pat. Off. . | |
| 34 09 194 | 9/1985 | Germany . | |
| 34 35 487 | 12/1987 | Germany . | |
| 39 18 128 | 12/1990 | Germany . | |
| 40 38 510 | 6/1992 | Germany . | |
| 1128644 | 9/1968 | United Kingdom | 101/248 |

*Primary Examiner*—Christopher A. Bennett
*Attorney, Agent, or Firm*—Cohen, Pontani,Lieberman & Pavane

[57] ABSTRACT

In a printing unit with two printing groups working together using the blanket-to-blanket method, in order to rotate the form cylinder and the transfer cylinder equally during circumferential register adjustment, the transfer cylinders are drive connected via helical gears and the transfer cylinders and the form cylinders of each printing group are drive connected via straight spur gears. The drive of the printing unit is carried out on one of the helical gears. Circumferential register adjustment of a printing group is carried out by movement of its helical gear.

9 Claims, 2 Drawing Sheets

DRIVE WITH RESISTER DEVICE FOR A PRINTING UNIT OF A ROTARY PRINTING MACHINE

BACKGROUND OF THE INVENTION

1. Field of the Invention

The invention relates to a drive with a register device for a printing unit of a rotary printing machine.

2. Description of the Prior Art

German reference DE 34 35 487 C2 discloses a printing unit with two printing groups, each of which contains a form cylinder and a transfer cylinder. The transfer cylinders can be positioned across from each other and thus print both sides of a web using the blanket-to-blanket method. The four cylinders are drive connected by a gear train of helical gears on the cylinder journals. The drive is carried out via one of the transfer cylinders. For the purpose of adjusting the lateral register, motors that act upon and move the form cylinders are arranged on the operator side. For the purpose of adjusting the circumferential register, motors that move the spur gears of the form cylinders are arranged on the drive side. It is disadvantageous in this device that during circumferential register adjustment, the form cylinder rotates relative to the transfer cylinder. As a result, in printing machines with form and transfer cylinders that have clamping channels, these channels rotate relative to one another. This results in enlargement of the non-printable bands between the printing images, i.e., in loss of printable area. This disadvantage also arises when the transfer cylinder is equipped with a rubber blanket and only the form cylinder has a channel. In this case, the channel leaves a mark on the rubber blanket, so that when the form cylinder later rotates relative to the transfer cylinder, this area is no longer suitable for transfer of the printing image. Furthermore, when welded form cylinder blankets are used, the welded seam leaves markings on the blanket of the transfer cylinder. In order to avoid this disadvantage during overall register adjustment, the printing unit has additional gearing, specifically, a spur gear in the drive gear train, which is moved to rotate the entire double printing unit. This represents a technical complication that is reflected in the manufacturing costs of the printing unit. The design also becomes considerably more complicated and expensive when the adjustment units of both the lateral and the circumferential register must be arranged on the drive side. These units must then be constructed in such a manner as to be completely nested one within the other. This requirement exists when sleeve-type printing and transfer forms are used. When these sleeves are changed, the cylinder journals on the operator side must be fully exposed.

A printing unit in which the adjustment devices for the lateral and circumferential register are arranged on the drive side is disclosed in EP 0 401 656 B1. In this case, the form cylinder journal carries a rotatable helical gear which engages with the spur gear of the transfer cylinder. The journal also carries a rigidly attached straight spur gear. A double toothed gear engages with the two toothed gears of the form cylinder. Axial movement of the form cylinder serves to adjust the lateral register, while the circumferential register is adjusted by axial movement of the double toothed gear. Once again, in the case of this device, the form cylinder rotates relative to the transfer cylinder during circumferential register adjustment, resulting in the disadvantages mentioned above. Furthermore, the addition toothed gear steps that are used can lead to poorer printing quality.

According to German reference DE 40 38 510 A1, two printing groups work together on the basis of the blanket-to-blanket principle. The two transfer cylinders are drive connected by helical gears, and the printing unit is driven on one of these gears. In addition, the transfer cylinder and the form cylinder of each printing group are in toothed engagement via respective helical gears. For circumferential register adjustment, the transfer cylinder in question is moved axially. The form cylinder and the transfer cylinder are rotated simultaneously, but not by the same angular amount. As a result, the channel of one cylinder is offset relative to the other cylinder and a print-free band is enlarged.

SUMMARY OF THE INVENTION

Accordingly, it is an object of the present invention to provide a drive, including a register adjustment, in which the form and transfer cylinders rotate simultaneously in the same direction and by the same angular amount during circumferential register adjustment.

Pursuant to this object, and others which will become apparent hereafter, one aspect of the present invention resides in a drive and a register device in a printing unit of a rotary printing machine having two printing groups, each of which printing groups contains a form cylinder and a transfer cylinder. The transfer cylinders are positioned across from one another to print on both sides of a web passed between them. The drive and register device includes helical gears attached in a non-rotatable fashion to the journals of the transfer cylinders and in drive connection with one another. Straight spur gears are mounted on the journals of the form cylinders and the transfer cylinders. The spur gears of the transfer cylinder and the form cylinder of each printing group being drivingly connected together. A further spur gear is in driving connection with the helical gear of one of the transfer cylinders. Means are also provided for axially moving the form cylinder for lateral register adjustment. The helical gears are slidably arranged on the journals of the transfer cylinders so as to be axially movable. Furthermore, means are provided for axially moving the helical gears on the transfer cylinder journals for adjusting circumferential register.

During circumferential register adjustment, the device rotates with the transfer cylinder in the same direction and by the same angular amount, so that print-free bands are not enlarged. An equally advantageous overall register setting is also possible without requiring additional gearing expense. Furthermore, the devices for the circumferential register and the lateral register can be placed on the drive side with simple design solutions. The drive including the register device can thus be produced economically. Finally, the design avoids additional toothed gear steps, so that the prerequisites for good print quality are achieved.

In a further embodiment of the invention, the straight spur gears are arranged in a single plane. The straight spur gears of the transfer cylinders are provided with toothings with profiles that are modified so that their tip circles having space between them.

In another embodiment of the invention the straight spur gears of one of the printing groups are arranged to lie on a different plane than the straight spur gears of the other of the printing groups.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
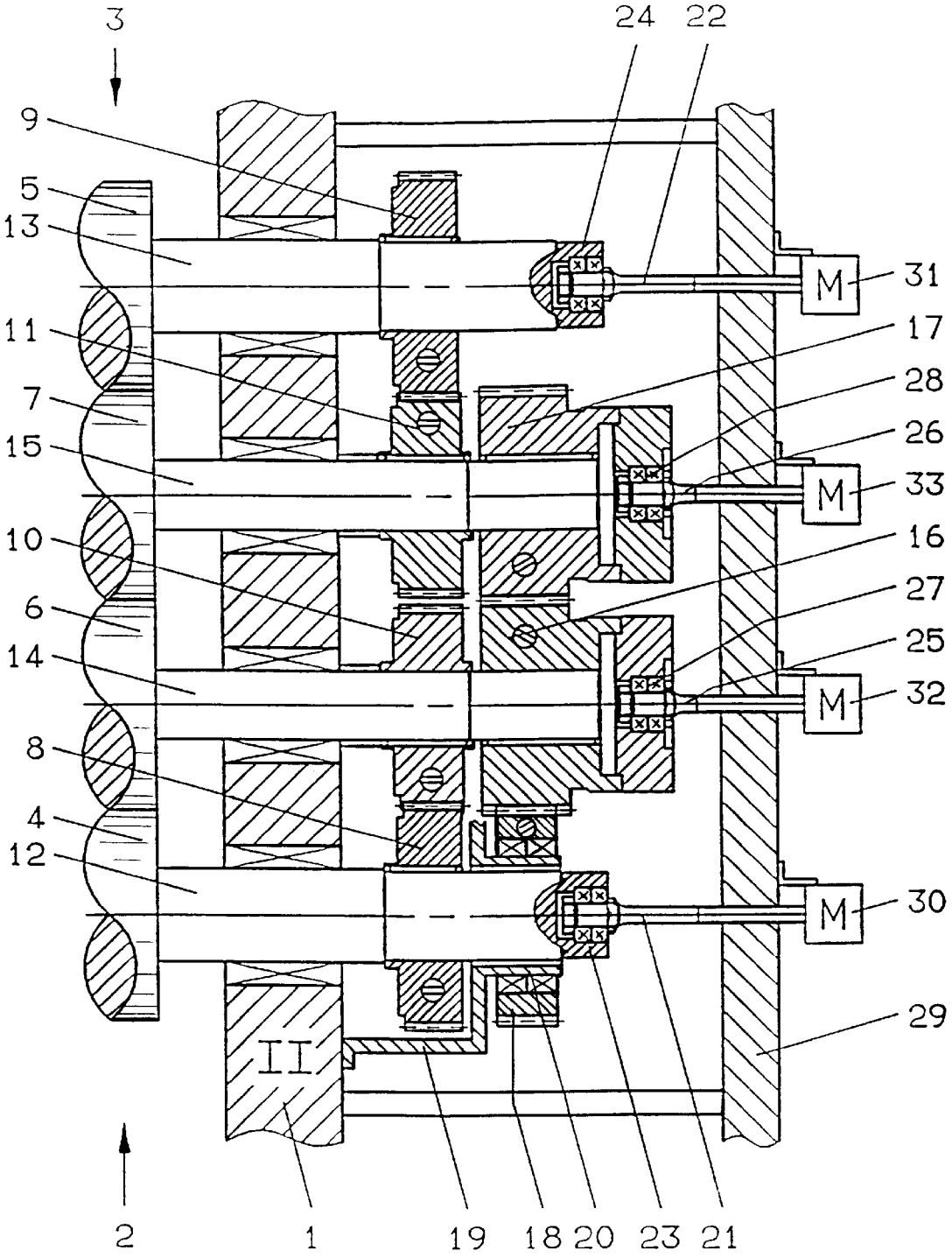
FIG. 1: is a partial drive-side sectional view of a printing unit embodying the present invention.

The printing unit shown in FIG. 1 contains two printing groups 2, 3 in the area of the drive-side side wall 1. Each of the printing groups has a form cylinder 4, 5 and a transfer cylinder 6, 7. The form cylinder 4, 5 and the transfer cylinder 6, 7 of each printing group 2, 3 are drive connected to straight spur gears 8–11, which are rigidly mounted on the cylinder journals 12–15. In FIG. 1, the assembly is shown as an adjusting spring connection. The spur gears can also be connected by means of conical clamping pieces, whereby setting the form and transfer cylinders 4–7 is advantageously possible. The straight spur gears 8–11 are located in one plane. To prevent the spur gears 10, 11 of the transfer cylinders 6, 7 from engaging, these gears have a suitable negative profile modification; the profile modification coefficient is approximately x=−1. Helical gears 16, 17 are also located on the journals 14, 15 of the transfer cylinders 6, 7 in an axially movable fashion. The mobility of the gears 16, 17 is achieved by means of the adjusting spring connection configuration. A splined shaft connection could also be used. The drive of the printing unit is carried out by a spur gear 18 that engages the helical gear of a transfer cylinder; in this case, onto the gear 16 of the transfer cylinder 6. The further drive path provided for the spur gear 18, in the form, for example, of a gear chain branching off from a longitudinal shaft, is not shown, because it does not form part of the invention. The spur gear 18 is mounted on a bridge 19 which is attached to the side wall 1 of the printing unit. The bridge 19 has a bore 20, through which the journal 12 (smaller in diameter than the bore 20) of the form cylinder 4 extends. This mounting has the advantage that the axial spacing of the toothed gears 16, 18 does not change during diagonal register adjustment. Thus, the transmission quality of the drive is not negatively impacted. In addition, the arrangement of the spur gear 18 in the middle of the form cylinder 4 has the advantage that during movement to adjust the transfer cylinder 6, the enlargement of the axial spacing of the spur gears 16 and 18, which are engaged with each other, is kept as small as possible.

The respective threaded spindles 21, 22, which are axially movable when rotated, act upon the journals 12, 13 of the form cylinders 4, 5 via a bearing 23, 24. In addition, the respective threaded spindles 25, 26, which are axially movable when rotated, act upon the helical gears 16, 17 of the transfer cylinders 6, 7 via a bearing 27, 28. To achieve axial mobility, the spindles 21, 22, 25, 26 are screwed into a guide plate 29, which is attached to the side wall 1. Each spindle 21, 22, 25, 26 is respectively coupled to a motor 30–33, which is attached to the guide plate 29. As an equivalent, the spindles 21, 22, 25, 26 could interact with nuts mounted rigidly elsewhere. The spindles could also be arranged in the interior of the form and transfer cylinders 4–7 and lead to the operator side of the printing unit, where they could then be operated. However, the affixation of the screws as shown in FIG. 1 has the advantage that the two-sided journals (not shown) of the form and transfer cylinders 4–7 can be exposed on the operator side, so that their sleeve-type printing and/or transfer forms can be changed, as needed.

The printing unit is driven by means of the spur gear 18. The spur gear 18 drives the transfer cylinders 6, 7 via the helical gears 16, 17. By means of their straight spur gears 10, 11, the transfer cylinders 6, 7 in turn drive the form cylinders 12, 13 via the straight spur gears 8, 9. To adjust the lateral register of the printing group 2, the motor 30 is activated. The spindle 21 set into rotation by the motor 30 is moved axially, depending on the rotational direction, and moves the form cylinder 4 via the bearing 23, which acts upon the journal 12. The form cylinder 4 is mounted in the frame so as to permit this movement, for example, by means of cylindrical roller bearings. The lateral register adjustment of the form cylinder 5 is carried out similarly by activation of the motor 31.

The circumferential register adjustment of the printing group 2 is carried out by activation of the motor 32. When this is done, the spindle 25 moves in one direction or the other, depending on the rotational direction, and in turn moves the helical gear 16 via the bearing 27. The transfer cylinder 6, which is mounted, for example, by means of spherical roller bearings, maintains its axial position. During this movement, the helical gear 16 rotates along with the transfer cylinder 6. This rotation is transmitted to the form cylinder 4 via the spur gears 10, 8. In the same way, the circumferential register of the printing group 3 is adjusted by activation of the motor 33. It is advantageous that when the circumferential register of a printing group 2, 3 is adjusted by rotation of the form cylinder 4, 5, the associated transfer cylinders 6, 7 also rotate at the same time. As a result, any clamping channels that might be located on these cylinders do not rotate relative to one another, and thus the non-printable bands between the repeats are not enlarged. The two devices to adjust the circumferential register of the printing groups 2, 3 can therefore also be used advantageously to adjust the overall circumferential register of the printing unit. For this purpose, the motors 32, 33 are activated at the same time and the spindles 25, 26 are rotated by equal angular amounts. These rotations can be carried out, for example, by means of direct-current motors with rotational angle control or by means of step motors.

Figure 2:
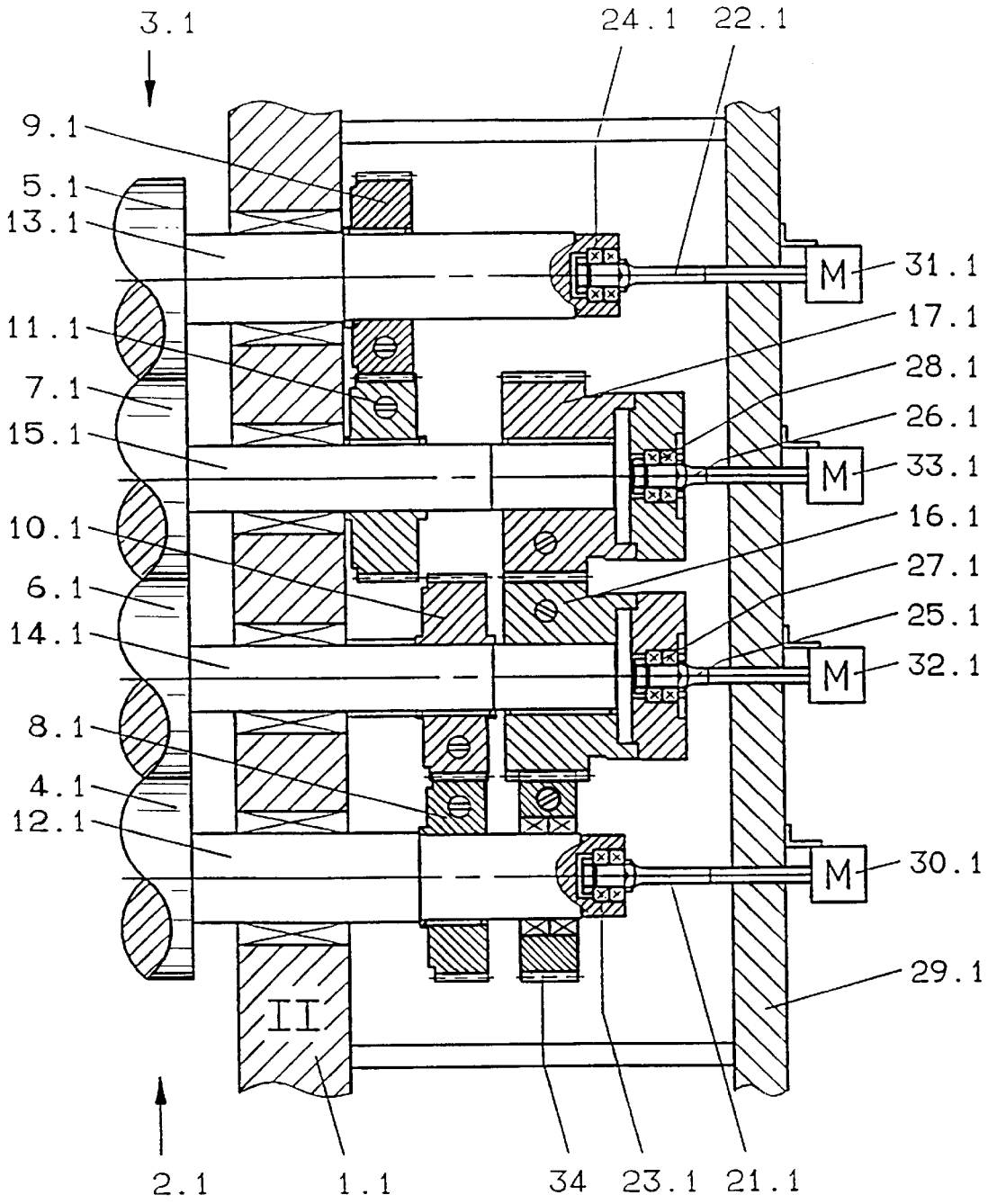
FIG. 2: shows a further embodiment of the invention.

FIG. 2 shows a further embodiment of the invention. For the sake of simplicity, reference numerals *.1 correspond to reference numerals * in FIG. 1. Insofar as structure or function remains the same as that in FIG. 1, a detailed description will not be given. The printing unit is driven by means of a spur gear 34, which is rotatably mounted directly on the journal 12.1 of the form cylinder 4.1. Although diagonal adjustment of the form cylinder 4.1 leads to additional circumferential adjustment on the drive side, the arrangement of the spur gear 34 in the middle of the form cylinder 4.1 has the advantage that during movement to adjust of the transfer cylinder 6.1, the axial spacing enlargement of the gears 16.1 and 34, which are engaged with one another, is kept as small as possible.

The embodiment according to FIG. 2 differs from that in FIG. 1 in that the spur gears 8.1 to 11.1 are arranged on two planes. More precisely, the spur gears 8.1, 10.1 of the printing group 2.1 are located on a different plane than the spur gears 9.1, 11.1 of the printing group 3.1. As a result, the spur gears 10.1, 11.1 do not need to be embodied with the large relative profile modification. Otherwise, the embodiment is the same as that shown in FIG. 1.

The invention is not limited by the embodiments described above which are presented as examples only but can be modified in various ways within the scope of protection defined by the appended patent claims.

We claim:

1. In a printing unit of a rotary printing machine having a sidewall and two printing groups, each of which printing groups contains a form cylinder and a transfer cylinder, the transfer cylinders of which are positionable across from one another to print on both sides of a web passed between them, the transfer cylinders and the form cylinders having journals, a drive and register device, comprising: helical gears attached in non-rotatable fashion to the journals of the transfer cylinders and in drive connection with one another; straight spur gears mounted on the journals of the form cylinders and the transfer cylinders, the spur gears of the transfer cylinder and the form cylinder of each printing group being drivingly connected; a further spur gear in driving connection with the helical gear of one of the transfer cylinders; means, acting upon each form cylinder, for axially moving the form cylinder for lateral register adjustment, the helical gears being slidably arranged on the journals of the transfer cylinders so as to be axially moveable; and means for axially moving the helical gears on the transfer cylinder journals for adjusting circumferential register.

2. A drive as defined in claim 1, wherein the straight spur gears are arranged in one plane, the straight spur gears of the transfer cylinders having toothing with profiles modified so that their tip circles have space between them.

3. A drive as defined in claim 1, wherein the straight spur gears of one of the printing groups are arranged to lie on a different plane than the straight spur gears of the other of the printing groups.

4. A drive as defined in claim 1, and further comprising a bridge mounted to the sidewall of the printing unit, the further spur gear being mounted on the bridge, the bridge having a bore arranged centrally relative to the further spur gear and having a diameter larger than that of the transfer cylinder journal, the transfer cylinder journal extending through the bore.

5. A drive as defined in claim 1, wherein the further spur gear is mounted on the journal of one of the form cylinders.

6. A drive as defined in claim 1, wherein the means for axially moving the helical gears includes a plurality of bearings and further includes a respective rotatable threaded spindle for each of the helical gears, each of the spindles being connected to the respective helical gear by a respective one of the plurality of bearings and being axially movable upon rotation.

7. A drive as defined in claim 1, wherein the means for moving the form cylinders includes a respective rotatable threaded spindle for each form cylinder journal, and a bearing arranged to connect the form cylinder journal to its respective spindle, the spindles being axially movable upon rotation.

8. A drive as defined in claim 6, and further comprising a guide plate attached to the sidewall of the printing unit, the spindles being mounted to the guide plate.

9. A drive as defined in claim 7, and further comprising a guide plate attached to the sidewall of the printing unit, the spindles being mounted to the guide plate.

* * * * *